United States Patent [19]

Lillibridge

[11] Patent Number: 4,506,452

[45] Date of Patent: Mar. 26, 1985

[54] METHOD AND APPARATUS FOR RF DRYING OF COATED ARTICLES

[75] Inventor: Harold R. Lillibridge, Burlingame, Calif.

[73] Assignee: Champion International Corporation, Stamford, Conn.

[21] Appl. No.: 438,023

[22] Filed: Nov. 1, 1982

[51] Int. Cl.[3] ..... F26B 3/34

[52] U.S. Cl. ..... 34/1; 34/68; 118/620; 118/643; 219/10.69; 219/10.81

[58] Field of Search ..... 34/1, 68; 118/620, 641, 118/642, 643; 219/10.81, 10.67, 10.69

[56] References Cited

U.S. PATENT DOCUMENTS

| | | | |
|---|---|---|---|
| 2,802,085 | 8/1957 | Rothacker | 219/10.53 |
| 3,866,255 | 2/1975 | Serota | 34/1 |
| 3,952,421 | 4/1976 | Wilson et al. | 34/1 |
| 3,965,851 | 6/1976 | Cohn | 118/620 |
| 4,055,295 | 10/1977 | Cohn | 34/1 |
| 4,104,804 | 8/1978 | Sargeant | 219/10.81 |
| 4,236,482 | 12/1980 | Gingerich et al. | 118/642 |
| 4,296,294 | 10/1981 | Beckert et al. | 34/1 |
| 4,397,262 | 8/1983 | Lillibridge et al. | 118/620 |

OTHER PUBLICATIONS

Serota, Rudy, *Automation*, Sep. 1973, "Heating With Radio Waves."

*Primary Examiner*—Larry I. Schwartz
*Assistant Examiner*—David W. Westphal
*Attorney, Agent, or Firm*—Evelyn M. Sommer; William W. Jones

[57] ABSTRACT

A method and apparatus for R.F. drying of coated articles, such as gummed envelope flaps wherein the wet gummed flaps are moved through a curvilinear array of electrodes comprising a plate and a grid. The envelopes are carried between two belts around a drum having the plate and grid disposed adjacent to the periphery of the drum. The R.F. current travels diagonally between offset electrodes mounted on the plate and grid. The plate and grid are mounted in a housing which includes an air circulating system to remove heat and moisture from the housing. A screen forms a portion of one wall of the housing through which heat and moisture are exhausted from the housing. The drum is provided with fan blades to remove heat and moisture from within the confines of the drum.

2 Claims, 4 Drawing Figures

METHOD AND APPARATUS FOR RF DRYING OF COATED ARTICLES

This invention relates to a method and apparatus for drying moist coatings applied to articles, and more particularly to the use of radio frequency (R.F.) current for the drying of moist adhesive applied to envelope flaps.

It is generally known to use R.F. energy for the drying of moist coatings applied to articles, or for the drying of moist materials per se. Various techniques relating to R.F. drying are disclosed in U.S. Pat. Nos. 2,802,085, issued to F. N. Rothacker; 3,952,421 issued to T. L. Wilson et al; 3,986,851 issued to R. Cohn; and 4,296,294 issued to A. Beckert et al. Additionally, an R.F. drying technique adapted for drying gummed envelope flaps is disclosed in copending U.S. application Ser. No. 354,669, filed Mar. 4, 1982 U.S. Pat. No. 4,397,262.

This invention relates to an R.F. drying apparatus and process which is particularly adaptable for drying gum or other moist material coated onto envelopes without damaging the envelopes during the drying process. The drying operation is accomplished in connection with the invention by controlled distribution of heat and with less power usage than was previously possible. These improvements are accomplished by means of a predetermined positioning of electrodes in the electrode array used for establishing the R.F. field in the dryer. The drying is accomplished as the envelopes are carried by carrier belts around a rotating drum with the portions of the envelopes to be dried projecting beyond the belts and beyond the edge of the drum. The electrode array is positioned adjacent to the edge of the drum so that the portions of the envelopes to be dried will project into the charged area between the electrodes so as to be exposed to the drying R.F. field. The electrode array is contained in a housing which surrounds the drum to form a drying chamber. The R.F. oscillator is contained in a portion of the housing and a fan is also positioned in the housing to cool the oscillator and force hot air out of the drying chamber. The top downstream portion of the housing is formed with a screen so that hot air can escape downstream of the drying chamber through the screen. The interior of the roller is open and is formed with fan blades which dissipate hot air as the roller rotates.

It is, therefore, an object of this invention to provide an improved apparatus and method for drying moist articles passed through an R.F. drying chamber.

It is an additional object of this invention to provide an improved apparatus and method of the character described wherein the articles are passed through the drying chamber on the curved surface of a rotating drum.

It is a further object of this invention to provide an improved apparatus and method of the character described wherein an electrode array is disposed in the drying chamber and positioned so that the articles to be dried pass between the electrodes and through the R.F. field created by the electrodes.

It is another object of this invention to provide an improved apparatus and method of the character described wherein moisture and heat are exhausted from the drying chamber during operation.

These and other objects and advantages of the invention will become more readily apparent from the following detailed description of a preferred embodiment of the invention when taken in conjunction with the accompanying drawings, in which.

Figure 4:
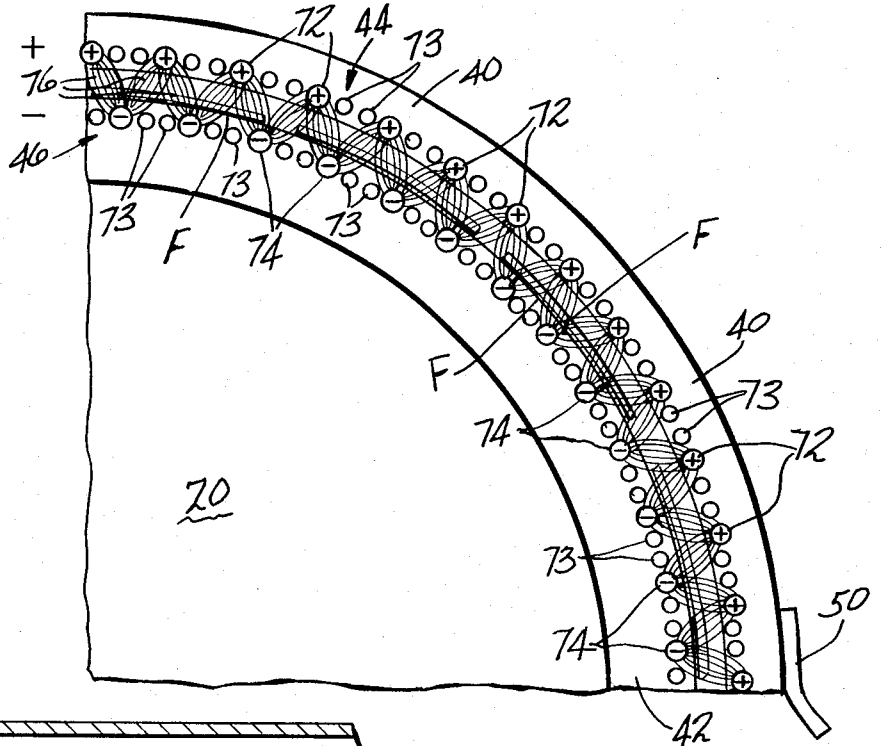
Figure 3:
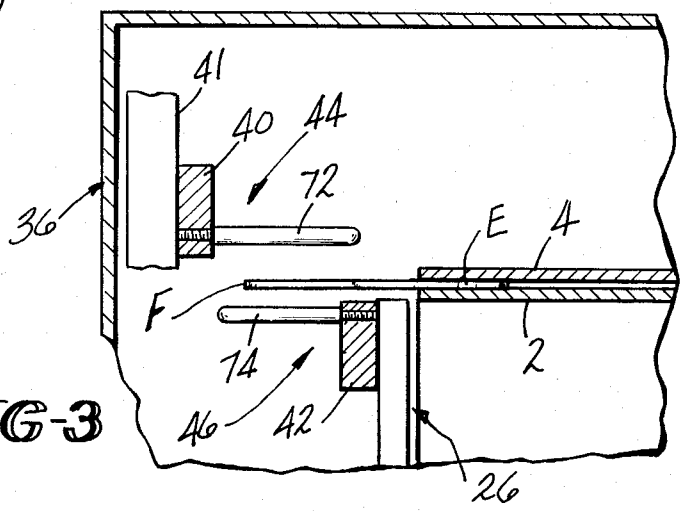

FIG. 3 is a fragmented transverse sectional view of the drying chamber housing showing a part of the electrode array position and how the gummed envelope flaps pass between the electrodes in the array; and FIG. 4 is a side elevational view of a fragmented portion of the electrode array showing passage of the gummed envelope flaps therethrough and showing the nature of the R.F. field formed by the electrode array.

Figure 1:
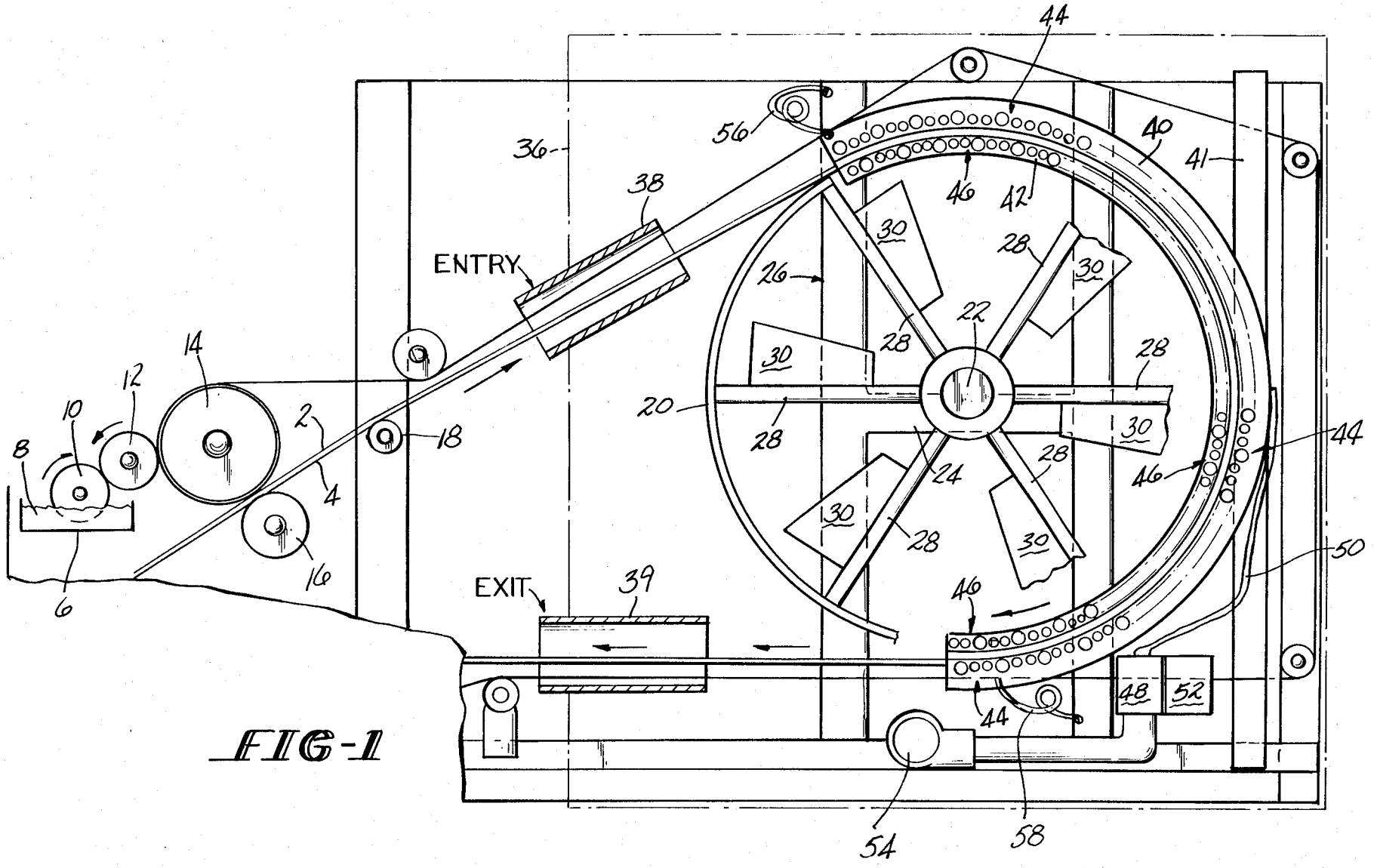
FIG. 1 is a somewhat schematic side elevational view of an envelope flap gluing and drying system which operates in accordance with this invention.

Referring now to the drawings, there is shown in FIG. 1, in somewhat schematic form, an apparatus which embodies this invention, and which apparatus is used to gum envelope flaps and subsequently dry the moist gum applied to the envelope flaps. The apparatus includes a pair of traveling belts 2 and 4 between which are sandwiched the envelopes whose flaps are being gummed and dried. It will be understood that the envelope flaps being gummed and dried project beyond the edges of belts 2 and 4 so as to be accessible to the gummer roll. Disposed above the belts 2 and 4 is a gum tray 6 in which a supply of gum 8 is contained. A gum pickup roll 10 extends into the gum 8 and rotates so as to pick up a layer of gum on its outer surface. Adjacent to the pickup roll 10 there is disposed a gum transfer roll 12 which contacts the pickup roll 10 so as to receive a layer of the gum on its outer surface. As the gum transfer roll 12 rotates it deposits a layer of gum on gum pads which are mounted on the outside surface of a gummer roll 14. The gummer roll 14 in turn applies a coating of gum, as it rotates, to the flaps of the envelopes which pass through the nip of the gummer roll 14 and a backup roll 16. The belts 2 and 4 with the gummed envelopes then pass over an idler roll 18 and travel around the exterior curved surface of a dryer roll 20. The dryer roll 20 has a central rotational shaft 22 which is journaled to the cross piece 24 of a support member 26, there being one support member 26 on each side of the dryer roll 20. The dryer roll 20 thus rotates between the support members 26. The dryer roll 20 is provided with internal radial spokes 28 to which are affixed fan blades 30. Thus, as the dryer roll 20 rotates, air is circulated through its interior by the fan blades 30. Surrounding the support member 26 and roll 20 in a housing 36 (shown in phantom in FIG. 1). The housing 36 forms a drying chamber through which the moist gummed envelope flaps pass and are dried. The belts 2 and 4 pass through entry passage 38 and exit passage 39 in the housing 36. Mounted to the support member 26 is a C-shaped electrode support 42. The electrode support 42 is provided with a plurality of drilled, tapped holes 46 in which electrodes are threaded. A second C-shaped electrode support 40 is mounted on a support post 41 disposed in the housing 36. The electrode support 40 is also provided with a plurality of drilled tapped holes 44 in which electrodes are threaded. The outer support 40 is connected to an R.F. oscillator 48 by means of a flat copper conductor 50, the connection being made at the mid point of the support 40. The oscillator 48 and a power generator 52 are contained in the lower portion 38 of the housing 36 and are cooled by a fan 54 also contained therein. The generator 52 is a 10 KW generator which operates on 220 V AC power which is converted to 4000 V DC used by the oscillator 48. The oscillator 48 develops a 27 megaherz R.F. field. Attached to each end of the outer support 40 are tuning coils 56 and 58. One end of each tuning coil 56 and 58 is connected to the support 40 and the other end is electrically grounded to the support member 26 which supports the dryer roll 20. The length of the tuning coils 56 and 58 controls the frequency of the R.F. field created by the oscillator 48, the tuning coils being essential to prevent arcing in the system. The fan 54, in addition to cooling the oscillator 48, also helps in blowing hot moist air out of the drying chamber. It will be noted that the inner support 42 is positioned so that the electrode support holes 46 lie closely inside of the curved outer surface of the dryer roll 20, the spacing being preferably about one-eighth of an inch.

Figure 2:
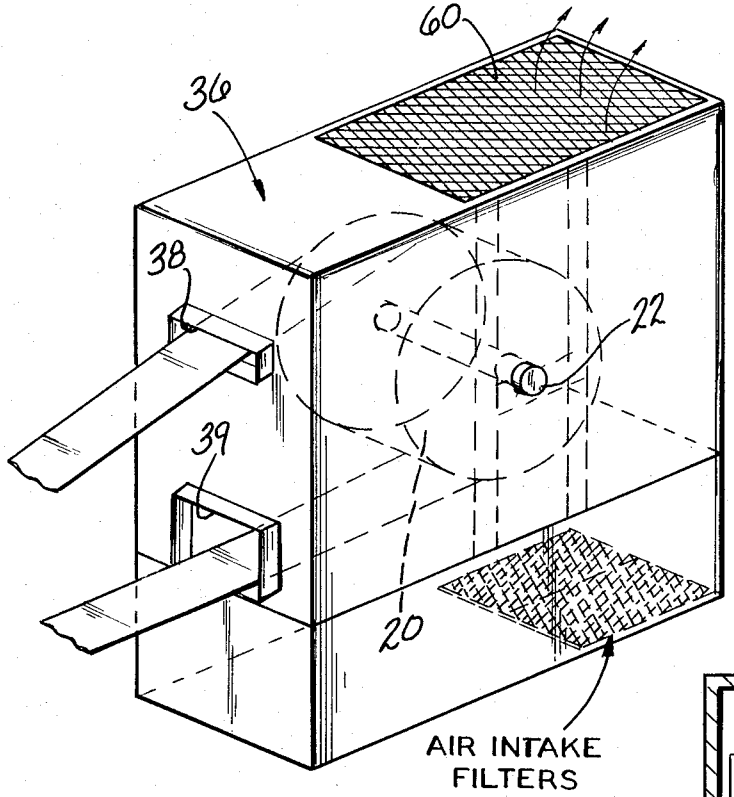
FIG. 2 is a somewhat schematic perspective view of the drying portion of the system of FIG. 1 showing the drying chamber housing.

Referring now to FIG. 2, it will be noted that the housing 36 surrounds the roll 20 and that the downstream portion of the top wall of the housing 36 is formed with a screen 60 through which the hot air from the drying chamber is exhausted by means of the aforementioned fan 54 and the air impelling action of the blades 30 mounted on the roll spokes 28, as shown in FIG. 1.

Referring now to FIG. 3, it will be seen that the flaps F on the envelopes E project beyond the belts 2 and 4 into the area between the electrodes 72 and 74 which are threaded into certain of the tapped holes 44 and 46 in the electrode supports 40 and 42 respectively. The electrodes 72 are the positive electrodes and the electrodes 74 are the negative electrodes. The electrode support 40 is mounted on the support member 41 and is electrically insulated therefrom while the electrode support 42 is electrically grounded by the support member 26 on which it is mounted. As the envelope flaps F pass through the drying chamber, they follow a path which is disposed between the positive electrodes 72 and the negative electrodes 74, thus the flaps F pass through the R.F. field generated between the positive and negative electrodes 72 and 74 respectively. It will be noted that the generator 52 generates direct current and that the R.F. field generated by the oscillator 48 and electrodes 72 and 74 is a stray R.F. field. The outer support 40 and the electrodes 72 connected thereto are the positive or plate portion of the R.F. dryer, and the inner support 42 and the electrodes 74 connected thereto are the negative or grid portion of the R.F. dryer.

Referring now to FIG. 4, a section of the plate and grid portions of the R.F. dryer is shown as the R.F. field is generated and the envelope flaps are passed through the R.F. field to dry. The specific placement of the positive and negative electrodes on the supports 40 and 42 and with respect to each other is highlighted. The positive electrodes 72 are positioned in every fourth one of the tapped holes 44. In each of the intervening two holes between the positive electrodes 72 there is positioned a non-conducting plug member 73 shaped like an electrode but made of plastic or some other non-conductor. The power cable 50 is also shown connected to the support 40. The negative electrodes 74 are positioned in every fourth one of the tapped holes 46 in the negative support 42. In each of the intervening two holes between the negative electrodes 74 there is positioned the non-conducting plugs 73. The positive and negative electrodes 72 and 74 respectively are not positioned directly across from each other, but rather are diagonally offset from or staggered with respect to each other. The spacing between associated positive and negative electrodes must be in the range of two inches to two and one-quarter inches, and is preferably about two and one-eighth inches.

It will be noted that the R.F. field formed consists of a plurality of generally elliptical electron streams 76 which move from the positive electrodes 72 to the negative electrodes 74. The electron streams 76 are generally elliptical and have pointed ends. An electron stream 76 can move from a positive electrode 72 to only one or to both of the closest diagonally offset negative electrodes 74. It will be noted that the elliptical electron streams 76 pass through the flaps F being dried at an acute angle due to the staggered positioning of the positive and negative electrodes 72 and 74, rather than at right angles, which would be the case were the positive and negative electrodes positioned directly opposite each other. The combination of the elliptical electron streams and the staggered positioning of the positive and negative electrodes 72 and 74 which causes the electrode streams to pass through the material being dried at acute angles results in the material being dried being exposed to a greater percentage of the R.F. field generated in the drier thereby resulting in a more complete drying of the material. The spacing between cooperating positive and negative electrodes is essential to the efficient operation of the system of this invention. The non-conducting plugs 73 also serve to support and guide the envelope flaps F as they pass through the drying chamber.

The system of this invention provides optimum efficiency in operation which is achieved by the staggered positioning of the electrodes and the rigidly controlled spacing between cooperating electrodes on the plate and grid. The system has proven operable with the production of only three kilowatts of power with the ten kilowatt generator, thereby illustrating the lower costs associated with the use of the system of this invention.

Since changes and variations of the disclosed embodiment of the invention may be made without departing from the inventive concept, it is not intended to limit the invention otherwise than as required by the appended claims.

What is claimed is:

1. Apparatus for R.F. drying of gummed envelope flaps, said apparatus comprising:

(a) a drying roll journaled for rotational movement about an axis, said drying roll including a plurality of internal spokes having fan blades mounted thereon for circulating heat and moisture within said apparatus;

(b) cooperating carrier belts for carrying gummed envelopes, said belts traveling over the outer surface of said drying roll and positioned on said drying roll so that gummed flaps of envelopes carried by said belts will travel over a predetermined path and project beyond the edges of said belts and one edge of said drying roll;

(c) a curvilinear grid electrode support mounted adjacent to said edge of said drying roll;

(d) a plurality of grid electrodes mounted on said grid electrode support;

(e) grounding means for electrically grounding said grid electrode support;

(f) a curvilinear plate electrode support mounted adjacent to the edge of said drying roll and spaced apart from said grid electrode support;

(g) a plurality of plate electrodes mounted on said plate electrode support, said plate electrodes being staggered with respect to said grid electrodes, with said plate and grid electrodes being operable to establish an R.F. field comprising elliptical electron streams which pass through said envelope flap path at acute angles thereto, and said plate electrodes being spaced apart from the closest cooperating grid electrodes a distance in the range of two inches to two and one-quarter inches;

(h) electrically grounded tuning coils attached to each end of said plate electrode support to control the frequency of the R.F. field created by said plate and grid electrodes and prevent arcing;

(i) a housing encasing said drying roll and said plate and grid electrode supports to form a drying chamber;

(j) a D.C. generator disposed in said housing;

(k) an R.F. oscillator disposed in said housing and operably connected to said D.C. generator; and (l) conducting means interconnecting said oscillator with a medial point on said plate electrode support.

2. Apparatus for R.F. drying of gummed envelope flaps, said apparatus comprising:

(a) a drying roll journaled for rotational movement about an axis;

(b) cooperating carrier belts for carrying gummed envelopes, said belts traveling over the outer surface of said drying roll and positioned on said drying roll so that gummed flaps of envelopes carried by said belts will travel over a predetermined path and project beyond the edges of said belts and one edge of said drying roll;

(c) a curvilinear grid electrode support mounted adjacent to said edge of said drying roll;

(d) a plurality of grid electrodes mounted on said grid electrode support;

(e) grounding means for electrically grounding said grid electrode support;

(f) a curvilinear plate electrode support mounted adjacent to the edge of said drying roll and spaced apart from said grid electrode support;

(g) a plurality of plate electrodes mounted on said plate electrode support, said plate electrodes being staggered with respect to said grid electrodes, with said plate and grid electrodes being operable to establish an R.F. field comprising elliptical electron streams which pass through said envelope flap path at acute angles thereto, and said plate electrodes being spaced apart from the closest cooperating grid electrodes a distance in the range of two inches to two and one-quarter inches;

(h) said plate and grid electrode supports each being provided with a plurality of apertures therein, with the apertures in each support being disposed directly opposite each other, said electrodes being mounted in non-consecutive ones of said apertures, and further comprising non-conductive envelope flap-guiding elements in each of the intervening ones of said apertures between said electrodes;

(i) electrically grounded tuning coils attached to each end of said plate electrode support to control the frequency of the R.F. field created by said plate and grid electrodes and prevent arcing;

(j) a housing encasing said drying roll and said plate and grid electrode supports to form a drying chamber;

(k) a D.C. generator disposed in said housing;

(l) an R.F. oscillator disposed in said housing and operably connected to said D.C. generator;

(m) conducting means interconnecting said oscillator with a medial point of said plate electrode support; and (n) means for cooling the interior of said housing.

* * * * *